US005252444A

United States Patent [19]

Yamada et al.

[11] Patent Number: 5,252,444

[45] Date of Patent: Oct. 12, 1993

[54] SILVER HALIDE COLOR PHOTOGRAPHIC LIGHT-SENSITIVE MATERIAL OFFERING EXCELLENT HUE REPRODUCTION

[75] Inventors: Yoshitaka Yamada, Hino; Hiroshi Shimazaki, Hachioji; Satoru Shimba, Kanagawa, all of Japan

[73] Assignee: Konica Corporation, Tokyo, Japan

[21] Appl. No.: 823,463

[22] Filed: Jan. 22, 1992

[30] Foreign Application Priority Data

Jan. 25, 1991 [JP] Japan ..... 3-7776

[51] Int. Cl.[5] ..... G03C 1/08; G03C 7/20

[52] U.S. Cl. ..... 430/503; 430/508; 430/504; 430/505

[58] Field of Search ..... 430/503, 504, 505, 508

[56] References Cited

U.S. PATENT DOCUMENTS

| | | | |
|---|---|---|---|
| 3,672,898 | 6/1972 | Schwan et al. | 430/508 |
| 4,663,271 | 5/1987 | Nozawa et al. | 430/503 |
| 4,816,378 | 3/1989 | Powers et al. | 430/508 |
| 5,037,728 | 8/1991 | Shiba et al. | 430/504 |

FOREIGN PATENT DOCUMENTS

| | | | |
|---|---|---|---|
| 0324471 | 7/1989 | European Pat. Off. | 430/505 |
| 0160449 | 7/1987 | Japan . | |

*Primary Examiner*—Richard L. Schilling

*Assistant Examiner*—Thomas R. Neville

*Attorney, Agent, or Firm*—Finnegan, Henderson, Farabow, Garrett & Dunner

[57] ABSTRACT

Disclosed is a silver halide color photographic light-sensitive material having at least one blue-sensitive silver halide emulsion layer, at least one green-sensitive silver halide emulsion layer and at least one red-sensitive silver halide emulsion layer on the support, wherein the maximum sensitivity wavelength $\lambda_B$ of the spectral sensitivity distribution in said blue-sensitive silver halide emulsion layer at 400 nm$\leqq\lambda_B\leqq$470 nm, the sensitivity of said blue-sensitive silver halide emulsion layer at 480 nm does not exceed 40% of the sensitivity at the maximum sensitivity wavelength $\lambda_B$ and the gradient of said blue-sensitive silver halide emulsion layer after blue light separation exposure $\gamma_{SB}$ and the gradient of said blue-sensitive silver halide emulsion layer after white light exposure $\gamma_{WB}$ bears the relationship of $\gamma_{SB}/\gamma_{WB}\leqq 1.25$.

The silver halide color photographic light-sensitive material according to this invention is capable of exactly reproducing the hues that have been difficult to reproduce, particularly the hues of red to magenta colors and the hues of green colors such as blue-green and green without being accomplished by degradation of the reproducibility for the primary colors.

8 Claims, No Drawings

SILVER HALIDE COLOR PHOTOGRAPHIC LIGHT-SENSITIVE MATERIAL OFFERING EXCELLENT HUE REPRODUCTION

FIELD OF THE INVENTION

The present invention relates to a color photographic light-sensitive material, more specifically a silver halide color photographic light-sensitive material which offers excellent hue reproduction.

BACKGROUND OF THE INVENTION

In recent years, there have been noticeable image quality improvements in silver halide multiple-layered color photographic light-sensitive materials. Specifically, with the recent progress of color photographic light-sensitive materials, major factors of image quality, particularly sharpness and graininess have reached a fair level; color prints and slide photographs of the service print size obtained by users are not said to be significantly unsatisfactory.

However, with respect to color reproducibility, one of the four factors of image quality, there have been improvements in color purity and brilliant and slightly accentuated reproduction is now possible, but much remains unsatisfactory as to hue reproduction, especially for the hues which have been difficult to exactly reproduce by photography. For example, so-called red-reflecting colors, which reflect light rays longer than 600 nm in wavelength, i.e., purple colors such as purple and blue-purple and green colors such as blue-green and yellow-green are sometimes reproduced into colors by far different from the original color, which may disappoint the user.

The major factors associated with color reproduction include the spectral sensitivity distribution and interimage effect (hereinafter abbreviated IIE) of color light-sensitive material. Improvement in color reproduction by IIE is disclosed in Japanese Patent Publication Open to Public Inspection (hereinafter referred to as Japanese Patent O.P.I. Publication) No. 2537/1975 and other publications. Specifically, it is known that a compound which couples with the oxidation product of color developing agent to form a development inhibitor or precursor thereof (DIR compound) has a color reproduction improving effect on silver halide multiple-layered color photographic light-sensitive materials due to IIE by retarding the development of other coloring layers by the development inhibitor released therefrom.

In the case of color negative films, it is possible to prevent color staining due to secondary absorption by the coupler by using a colored coupler in such amounts that the undesirable absorption (secondary absorption) is compensated. It is also possible to obtain an IIE-like effect by using the colored coupler in amounts higher than the minimum secondary absorption compensating level.

However, when using a colored coupler in excess, the increase in minimum film density makes right judgment of printing color/density correction very difficult and lengthens printing time and thus degrades workability in laboratories.

These techniques have contributed to improvements in color reproduction, especially color purity. Having an inhibiting group or precursor with high mobility, diffusible DIR, which has recently been commonly used, causes hue change, though color purity can be improved, if its orientation is not well controlled.

With respect to spectral sensitivity distribution, Japanese Patent Examined Publication No. 6207/1974 discloses a method in which a filter layer etc. are used to shift the spectral sensitivity distributions in the blue-sensitive and red-sensitive silver halide emulsion layers (hereinafter referred to as blue-sensitive layer and red-sensitive layer for short) toward the spectral sensitivity distribution of the green-sensitive layer to mitigate the fluctuation in color reproduction among different light sources for picture taking.

However, this does not serve as a means of improving hue reproduction for the colors difficult to reproduce. Moreover, it causes significant sensitivity reduction and narrows the color reproduction range due to the wide overlap of spectral sensitivity distribution among the color sensitive layers, which hampers satisfactory reproduction of highly chromatic colors, though reproducibility is little affected by color temperature change.

Generally, in controlling spectral sensitivity distribution, short wave shift of red-sensitive layer is important from the viewpoint of approximation of the peak wavelength of light-sensitive material to the human optic sensitivity for exact hue reproduction. Short wave shift of red-sensitive layer is particularly important in the reproduction of so-called red-reflecting colors such as reproduction of blue-purple color in the reproduction of flower colors.

However, such short wave shift of red-sensitive layer results in chromaticity reduction, causing disadvantages in the reproducibility for skin color, which is important in the color reproduction in color photography, i.e., the healthy reddishness unique to skin color is lost and the color reproduced lacks liveliness.

Japanese Patent O.P.I. Publication Nos. 20926/1978 and 131937/1984 disclose arts of short wave shift, in which the spectral sensitivity distribution in the red-sensitive layer is shifted toward that in the green-sensitive layer, but neither offers a satisfactory effect. Japanese Patent O.P.I. Publication No. 181144/1990 specifies the sensitivity difference between the blue-sensitive layer and the green-sensitive layer and the yellow filter layer density at 480 nm to improve the reproduction of blue-green and other colors.

Also, an art in which spectral sensitivity and IIE are specified is disclosed in Japanese Patent O.P.I. Publication No. 160449/1987, in which IIE orientation is specified for each light-sensitive layer.

Japanese Patent O.P.I. Publication No. 160448/1987 discloses an art in which a negative spectral sensitivity corresponding to the human eye spectral sensitivity is obtained by providing a cyan-containing light-sensitive layer and applying IIE on the red-sensitive layer. Specifically, in addition to the essential blue-, green- and red-sensitive layers, an IIE expression layer (cyan containing light-sensitive layer) is required to obtain the desired IIE effect, which increases the amount of silver coated raises production cost, and the obtained effect is unsatisfactory. None of the arts described above offers satisfactory color reproduction; there have been demands for light-sensitive materials offering good color reproduction.

SUMMARY OF THE INVENTION

The object of the present invention is to provide a silver halide color photographic light-sensitive material capable of exactly reproducing the hues which have been difficult to reproduce, particularly the hues of red to magenta colors and the hues of green colors such as blue-green and green without being accompanied by degradation of the reproducibility for the primary colors.

The present inventors made investigations and accomplished the object of the present invention described above by means of a silver halide color photographic light-sensitive material having at least one blue-sensitive silver halide emulsion layer, at least one green-sensitive silver halide emulsion layer and at least one red-sensitive silver halide emulsion layer on the support, wherein the maximum sensitivity wavelength $\lambda_B$ of the spectral sensitivity distribution in said blue-sensitive silver halide emulsion layer falls in the range of 400 nm$\leqq\lambda_B\leqq$470 nm, the sensitivity of said blue-sensitive silver halide emulsion layer at 480 nm does not exceed 40% of the sensitivity at the maximum sensitivity wavelength $\lambda_B$ and the gradient of said blue-sensitive silver halide emulsion layer after blue light separation exposure $\gamma$SB and the gradient of the blue-sensitive silver halide emulsion layer after white light exposure $\gamma_{WB}$ bears the relationship of $\gamma_{SB}/\gamma_{WB}\geqq 1.25$.

The present invention is hereinafter described in detail.

DETAILED DESCRIPTION OF THE INVENTION

In the present invention, spectral sensitivity distribution is defined as a function of wavelength wherein the light-sensitive material is exposed to spectral light between 380 nm and 700 nm at intervals of several nanometers and its sensitivity is expressed as the reciprocal of the amount of exposure which provides a density of minimum density +1.0 at each wavelength. In the present invention, the spectral sensitivity distribution in the blue-sensitive layer should fall in the range of 400 nm$\leqq$maximum sensitivity wavelength $\lambda_B\leqq$470 nm, preferably 405$\leqq\lambda_B\leqq$465 nm, and more preferably 410 nm$\leqq\lambda_B\leqq$460 nm. Also, the sensitivity of the blue-sensitive layer at $\lambda$=480 nm should be not more than 40%, preferably not more than 30%, and more preferably not more than 20% of its maximum sensitivity.

Although there is no limitation on the spectral sensitivity of the green- or red-sensitive layer, the maximum sensitivity wavelength is preferably 520 nm$\leqq\lambda_G$570 nm and 590 nm$\leqq\lambda_R\leqq$640 nm, more preferably 530 nm$\leqq\lambda_G\leqq$555 nm and 600 nm$\leqq\lambda_R\leqq$630 nm.

In the present invention, to obtain the above-mentioned constitution of the spectral sensitivity distribution in the blue-sensitive layer, any appropriate means can be used. Examples of usable means include the method in which a given silver halide is spectrally sensitized with a sensitizing dye having an absorption spectrum in the desired wavelength band, the method in which the halogen composition or distribution of silver halide is optimized using no sensitizing dye to obtain the desired spectral sensitivity, and the method in which an appropriate light absorbent is used in the light-sensitive material to obtain the desired spectral sensitivity distribution.

Examples of sensitizing dyes preferably used in the blue-sensitive layer to obtain the desired spectral sensitivity distribution in the light-sensitive material of the present invention are given below.

SS-1

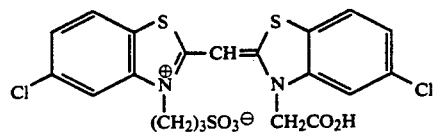

SS-2

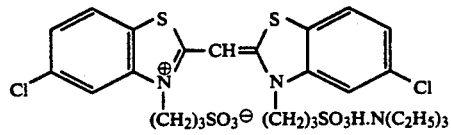

SS-3

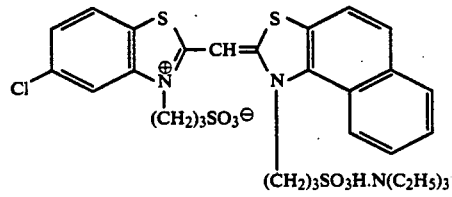

SS-4

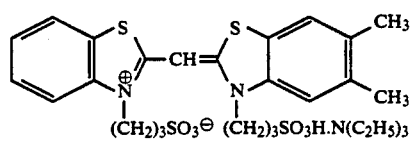

SS-5

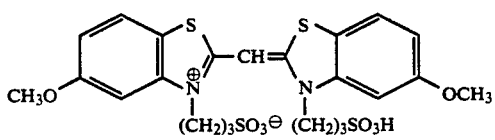

SS-6

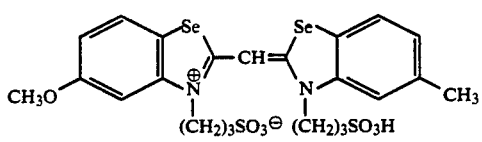

SS-7

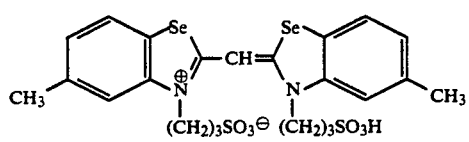

SS-8

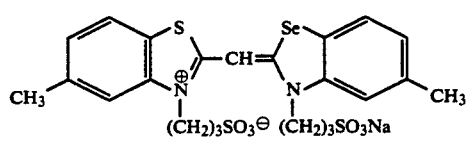

SS-9

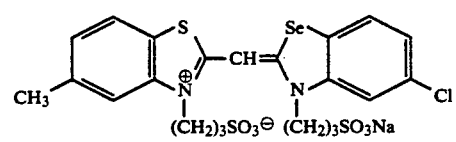

SS-10

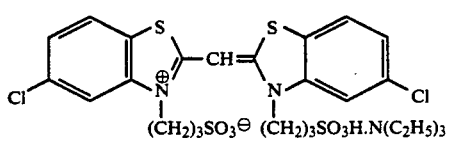

-continued

SS-11

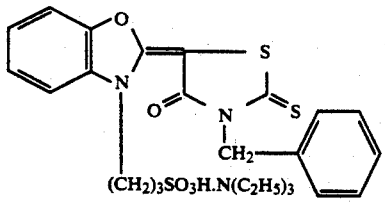

SS-12

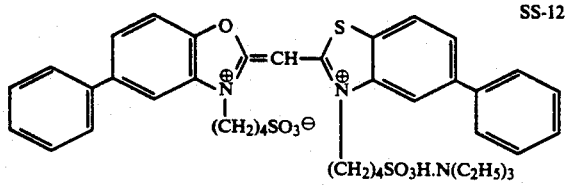

SS-13

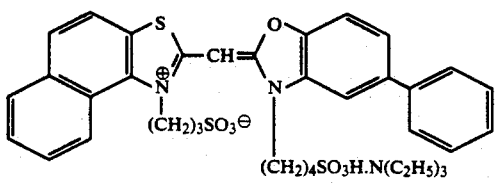

SS-14

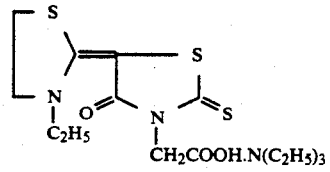

In the present invention, any known light-sensitive silver halide can be used in each light-sensitive layer. Although the light-sensitive silver halide is preferably composed of silver iodobromide, which is commonly used in picture taking materials, silver chloroiodobromide, silver bromide, silver chloride and others can also be used.

With respect to the blue-sensitive layer, it is preferable to use a silver iodobromide or silver chloroiodobromide having a silver iodide content of not more than 4 mol %, more preferably not more than 3 mol % from the viewpoint of control of the spectral sensitivity distribution in the blue-sensitive layer and easy obtainment of IIE.

It is also preferable that at least the silver halide in the blue-sensitive layer contain tabular silver halide grains.

The tabular silver halide emulsion for the present invention preferably has an aspect ratio (diameter/-thickness) of not less than 3.0, more preferably 3.5 to 10, and still more preferably 4.0 to 8.0.

The diameter of a grain mentioned here is defined as the diameter of the circle occupying the same area as the projected area of a silver halide grain as determined on an electron micrograph of the grain.

The projected area of a grain can be calculated from the sum of these grain areas. In any case, the area can be obtained by electron microscopy of a silver halide crystal sample whose grains are spread over a sample table to such extent that no grains overlap each other. The thickness of a grain can be determined by obliquely observing the sample using an electron microscope and is expressed as the distance between two parallel planes constituting the tabular silver halide grain.

With respect to the tabular silver halide emulsion for the present invention, the silver halide grains having an aspect ratio of not less than 3.0 preferably account for not less than 50%, more preferably not less than 60%, and ideally not less than 70% of all silver halide grains.

The tabular silver halide emulsion for the present invention is preferably a monodispersed emulsion, and it is more preferable that the silver halide grains falling in the grain size range of ±20% around the average grain diameter $d_m$ account for not less than 50% by weight.

Here, the average grain size $d_m$ is defined as the grain diameter di which gives a maximum value for $n_i \times d_i^3$, wherein $d_i$ denotes the grain diameter and ni denotes the number of grains having a diameter of $d_i$ (significant up to three digits, rounded off at the last digit).

The grain diameter stated here is the diameter of the diameter of a circle converted from a grain projection image with the same area.

Grain size can be obtained by measuring the diameter of the grain or the area of projected circle on an electron micrograph taken at ×10000 to 50000 (the number of subject grains should be not less than 1000 randomly).

A highly monodispersed emulsion preferred for the present invention has a distribution width of not more than 20%, more preferably not more than 15% as calculated using the following equation:

$$(\text{Grain size standard deviation}/\text{average grain size}) \times 100 = \text{distribution width } (\%)$$

Here, average grain size is measured in accordance with the measuring method described above. Average grain size is obtained as an arithmetic mean.

$$\text{Average grain size} = \Sigma d_i n_i \Sigma n_i$$

The tabular silver halide emulsion for the present invention is preferably a silver iodobromide or silver chloroiodobromide emulsion having an average silver iodide content of less than 4.0 mol %, more preferably 0 to 3.0 mol %, and ideally 1 to 2.5 mol %.

A silver halide emulsion preferably used for the present invention can be obtained by localizing silver iodide in the grains. A preferred mode is that a silver iodobromide having a lower silver iodide content is deposited on the core having a higher silver iodide content.

The silver iodide content of the core is preferably 5 to 45 mol %, more preferably 10 to 40 mol %.

The silver iodide contents of the shell and the core are preferably different from each other by not less than 10 mol %, more preferably not less than 20 mol %, and ideally not less than 30 to 40 mol %.

In the above-mentioned mode, another silver halide phase may be present in the central portion of the core or between the core and the shell.

The volume of the shell preferably accounts for 10 to 90 mol %, more preferably 50 to 80 mol % of the total volume of all grains. The core, shell and other silver halide phases may have the same composition, or may be a group of uniformly composed phases wherein the group composition changes step by step, or may be a group of phases wherein the phase composition changes continuously, or may be a combination thereof.

It is another mode of the present invention that the silver iodide content changes continuously from the center to outside of the grain and the silver iodide localized in the grains does not form a substantially uniform phase. In this case, the silver iodide content preferably decreases monotonously outwardly from the point of maximum silver iodide content in the grains.

The silver halide is preferably a silver iodobromide wherein the silver iodide content in the grain surface region is not more than 7 mol %, more preferably 0 to 5 mol %, and ideally 0 to 3.0 mol %.

A tabular silver halide emulsion can be produced in accordance with Japanese Patent O.P.I. Publication Nos. 113926/1983, 113927/1983, 113934/1983 and 1855/1987, European Patent Nos. 219,849 and 219,850 and other publications.

For obtaining a silver halide emulsion for the present invention, it is preferable to deposit a silver iodobromide phase or silver bromide phase on the monodispersed seed crystal.

A monodispersed tabular silver halide emulsion can be prepared in accordance with Japanese Patent O.P.I. Publication No. 6643/1986 and other publications.

Examples of the silver halide solvent used in the seed grain formation process for the present invention include (a) the organic thioethers described in U.S. Pat. Nos. 3,271,157, 3,531,289 and 3,574,628, Japanese Patent O.P.I. Publication Nos. 1019/1979 and 158917/1979, and Japanese Patent Examined Publication No. 30571/1983, (b) the thiourea derivatives described in Japanese Patent O.P.I. Publication Nos. 82408/1978, 29829/1980 and 77737/1980, (c) the AgX solvents having a thiocarbonyl group between an oxygen or sulfur atom and a nitrogen atom, described in Japanese Patent O.P.I. Publication No. 144319/1978, (d) the imidazoles described in Japanese Patent O.P.I. Publication No. 100717/1979, (e) sulfites, (f) thiocyanates, (g) ammonia, (h) the hydroxyalkyl-substituted ethylenediamines described in Japanese Patent O.P.I. Publication No. 196228/1982, (i) the substituted mercaptotetrazoles described in Japanese Patent O.P.I. Publication No. 202531/1982, (j) water-soluble bromides, and (k) the benzimidazole derivatives described in Japanese Patent O.P.I. Publication No. 54333/1983.

Gradient ($\gamma$ value) can be obtained by measuring a sample developed after white light exposure and color separation exposure using a Status M filter and determining the gradient in the exposure range for $\Delta \log E = 1.0$ from $D_{min} + 0.3$ on the characteristic curve thus obtained.

Single color light separation exposure for blue, green and red colors means exposure with a light ray having spectral energy corresponding to the spectral sensitivity distribution in each light-sensitive emulsion layer. For blue light exposure, green light exposure and red light exposure, Wratten gelatin filters W-98, W-99 and W-26, respectively, can be used for colorimetry.

White light exposure in the present invention is as generally mentioned by those skilled in the art, and is achieved using a light source with a color temperature of 4800 K. to 5500 K.

In the present invention, the blue-sensitive layer gradient in blue light separation exposure $\gamma_{SB}$ and the blue-sensitive layer gradient in white light exposure $\gamma_{WB}$ should bear the relationship of $\gamma_{SB}/\gamma_{WB} \leqq 1.25$. If the ratio exceeds the upper limit of about 2.5, processing fluctuation tends to widen. The ratio is preferably $1.35 \leqq \gamma_{SB}/\gamma_{WB} \leqq 2.10$, more preferably $1.45 \leqq \gamma_{SB}/\gamma_{WB} \leqq 2.00$.

Although this value is difficult to specify decisively because it is affected by various factors including silver halide grain developability, diffusion rate in the film, film thickness, inhibitability by inhibitor and coupler coupling speed, it is advantageous to regulate IIE with a DIR compound.

Generally, a blue-sensitive layer separation in blue light exposure $\gamma_{SB}$ higher than that in white light exposure $\gamma_{WB}$ means a great IIE on the blue-sensitive layer.

The IIE on the blue-sensitive layer is attributable to the green- and red-sensitive layers. From the viewpoint of enhancement of the effect of the present invention, it is desirable that the IIE of the green-sensitive layer on the blue-sensitive layer is intense. Specifically, it is preferable to add a diffusible DIR compound to the green-sensitive layer adjoining the blue-sensitive layer.

From the viewpoint of graininess and latitude, it is preferable that the green-sensitive layer comprise a number of layers including a high-speed layer, a low-speed layer and if necessary a moderate-speed layer. It is a preferred mode of embodiment of the present invention to add a diffusible DIR compound to the maximum sensitivity layer.

With respect to the green- and red-sensitive layers as well as the blue-sensitive layer, the separation $\gamma$ obtained in single light exposure is desirably higher than that obtained with white light. The ratio is preferably $\gamma_{SG}/\gamma_{WG} \leqq 1.15$ and $\gamma_{SR}/\gamma_{WR} \leqq 1.30$, more preferably $\gamma_{SG}/\gamma_{WG} \leqq 1.30$ and $\gamma_{SR}/\gamma_{WR} \leqq 1.40$, respectively.

In the present invention, it is preferable to add a diffusible DIR compound, which releases a development inhibitor or precursor thereof upon reaction with the oxidation product of developing agent, as stated above.

Examples of diffusible DIR compounds which can be used for the present invention are given in U.S. Pat. Nos. 4,234,678, 3,227,554, 3,617,291, 3,958,993, 4,149,886, 3,933,500, 2,072,363 and 2,070,266, Japanese Patent O.P.I. Publication Nos. 56837/1982 and 13239/1976, Research Disclosure No. 21228 (December 1981) and other publications. The diffusible DIR compounds shown in Japanese Patent O.P.I. Publication No. 110452/1990, pp. 485–489, are especially preferable.

The silver halide emulsion used in the color photographic light-sensitive material of the present invention may be chemically sensitized by a conventional method.

The silver halide emulsion may contain an antifogging agent, stabilizer and other additives. It is advantageous to use gelatin as the binder for the emulsion (this is not to be construed as limitative).

The emulsion layers and other hydrophilic colloidal layers may be hardened and may contain a plasticizer and a dispersion (latex) of water-insoluble or sparingly soluble synthetic polymer.

The present invention is preferably applicable to picture taking light-sensitive materials such as color negative films and color reversal films.

The emulsion layer for the color photographic light-sensitive material of the present invention incorporates a known color developing developer.

It is also possible to use a colored coupler and competitive coupler having a corrective effect, and a chemical substance which releases a photographically useful fragment such as a development accelerator, bleach accelerator, developer, silver halide solvent, toning agent, hardener, fogging agent, antifogging agent, chemical sensitizer, spectral sensitizer and desensitizer upon coupling with the oxidation product of developing agent.

The light-sensitive material may be provided with auxiliary layers such as filter layers, anti-halation layers and anti-irradiation layers. These layers and/or emulsion layers may contain a dye which oozes out or bleached from the light-sensitive material during the developing process.

The light-sensitive material may be formulated with a formalin scavenger, brightener, matting agent, lubricant, image stabilizer, surfactant, anti-stain agent, development accelerator, development retarder and bleach accelerator.

Any substance can be used as the support, such as polyethylene-laminated paper, polyethylene terephthalate films, baryta paper and cellulose triacetate.

A dye image can be obtained using the color photographic light-sensitive material of the present invention by carrying out an ordinary color photographic process after exposure.

EXAMPLE

The present invention is hereinafter described in more detail by means of the following example.

In the following example, the amount of addition to the silver halide photographic light-sensitive material is expressed in gram per $m^2$, unless otherwise specified. Also, the amount of silver halide and colloidal silver is expressed as the amount of silver. For sensitizing dyes, the amount is expressed as molar ratio to mol of silver halide in the same layer.

Layers having the following compositions were formed on a triacetyl cellulose film support in this order from the support side to yield a multiple-layered color photographic light-sensitive material sample No. 101.

| Sample No. 101 | |
|---|---|
| Layer 1: Anti-halation layer | |
| Black colloidal silver | 0.18 |
| UV absorbent UV-1 | 0.23 |
| High boiling solvent Oil-1 | 0.20 |
| Gelatin | 1.48 |
| Layer 2: Interlayer | |
| Gelatin | 1.00 |
| Layer 3: Low speed red-sensitive emulsion layer | |
| Monodispersed silver iodobromide emulsion A1 (average grain size 0.27 μm, average silver iodide content 7 mol %, distribution width 13%) | 0.70 |
| Sensitizing dye SD-1 | $6.0 \times 10^{-4}$ |
| Sensitizing dye SD-2 | $5.5 \times 10^{-4}$ |
| Cyan coupler C-1 | 0.60 |
| Colored cyan coupler CC-1 | 0.15 |
| DIR compound DD-1 | 0.04 |
| DIR compound DD-3 | 0.004 |
| High boiling solvent Oil-1 | 0.50 |
| Gelatin | 1.0 |
| Layer 4: High speed red-sensitive emulsion layer | |
| Monodispersed silver iodobromide emulsion B1 (average grain size 0.38 μm, average silver iodide content 7 mol %, distribution width 14%) | 0.88 |
| Sensitizing dye SD-1 | $2.2 \times 10^{-4}$ |
| Sensitizing dye SD-2 | $2.0 \times 10^{-4}$ |
| Cyan coupler C-1 | 0.13 |
| Colored cyan coupler CC-1 | 0.01 |
| DIR compound DD-1 | 0.03 |
| DIR compound DD-3 | 0.005 |
| High boiling solvent Oil-1 | 0.15 |
| Gelatin | 1.10 |
| Layer 5: Interlayer | |
| Anti-color staining agent SC-1 | 0.10 |
| High boiling solvent Oil-2 | 0.10 |
| Gelatin | 1.00 |
| Layer 6: Low speed green-sensitive emulsion layer | |
| Monodispersed silver iodobromide emulsion A1 | 0.90 |
| Sensitizing dye SD-2 | $8.5 \times 10^{-5}$ |
| Sensitizing dye SD-3 | $8.0 \times 10^{-4}$ |
| Magenta coupler M-1 | 0.53 |
| Colored magenta coupler CM-2 | 0.09 |
| High boiling solvent Oil-2 | 0.70 |
| Gelatin | 1.10 |
| Layer 7: High speed green-sensitive emulsion layer | |
| Monodispersed silver iodobromide emulsion B1 | 0.90 |
| Sensitizing dye SD-4 | $3.0 \times 10^{-4}$ |
| Sensitizing dye SD-5 | $1.8 \times 10^{-4}$ |
| Magenta coupler M-1 | 0.17 |
| Colored magenta coupler CM-1 | 0.08 |
| High boiling solvent Oil-2 | 0.40 |
| Gelatin | 0.90 |
| Layer 8: Yellow filter layer | |
| Yellow colloidal silver | 0.11 |
| Anti-color staining agent SC-1 | 0.08 |
| High boiling solvent Oil-2 | 0.08 |
| Gelatin | 1.00 |
| Layer 9: Low speed blue-sensitive emulsion layer | |
| Monodispersed silver iodobromide emulsion A1 | 0.45 |
| Sensitizing dye SD-6 | $7.0 \times 10^{-4}$ |
| Yellow coupler Y-1 | 0.40 |
| Yellow coupler Y-2 | 0.30 |
| DIR compound DD-1 | 0.01 |

-continued

| Sample No. 101 | |
|---|---|
| High boiling solvent Oil-2 | 0.06 |
| Gelatin | 0.90 |
| Layer 10: High speed blue-sensive emulsion layer | |
| Monodispersed silver iodobromide emulsion B1 | 0.65 |
| Sensitizing dye SD-6 | $4.8 \times 10^{-4}$ |
| Yellow coupler Y-1 | 0.18 |
| High boiling solvent Oil-2 | 0.08 |
| Gelatin | 0.50 |
| Layer 11: First protective layer | |
| Fine grains of silver iodobromide emulsion (average grain size 0.08 μm) | 0.40 |
| UV absorbent UV-1 | 0.07 |
| UV absorbent UV-2 | 0.10 |
| High boiling solvent Oil-1 | 0.07 |
| High boiling solvent Oil-3 | 0.07 |
| Gelatin | 0.65 |
| Layer 12: Second protective layer | |
| Alkali-soluble matting agent (average grain size 2 μm) | 0.15 |
| Polymethyl methacrylate (average grain size 2.2 μm) | 0.04 |
| Lubricant WAX-1 | 0.04 |
| Gelatin | 0.60 |

C-1

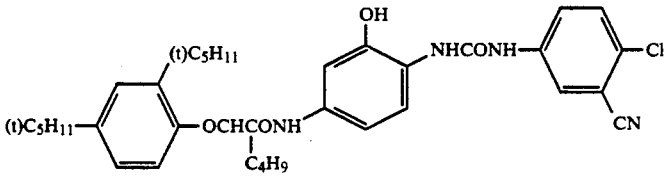

M-1

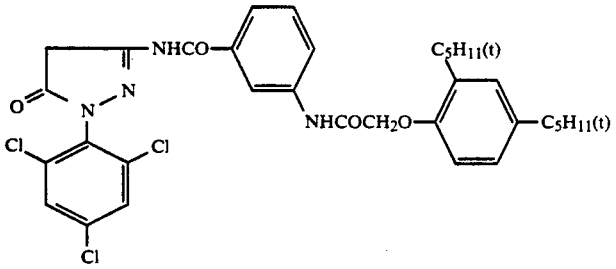

Y-1

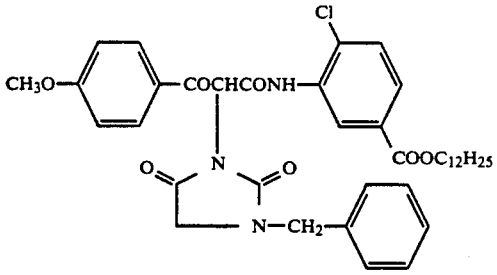

Y-2

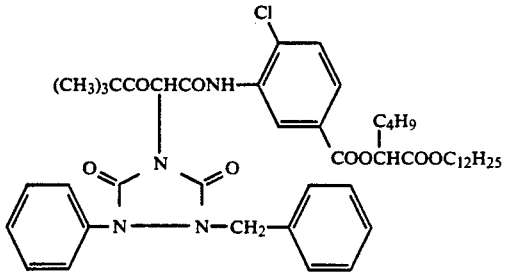

-continued
Sample No. 101
CC-1
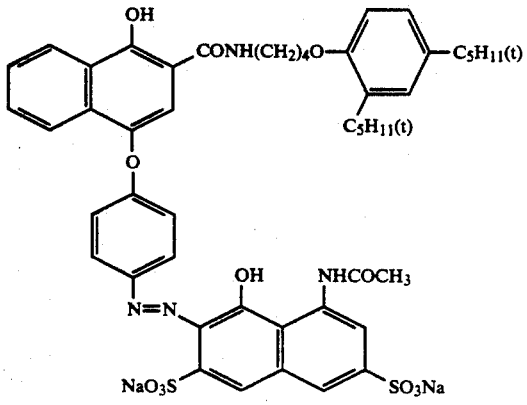
CM-1
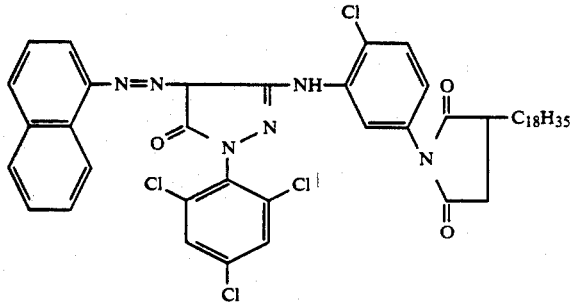
CM-2
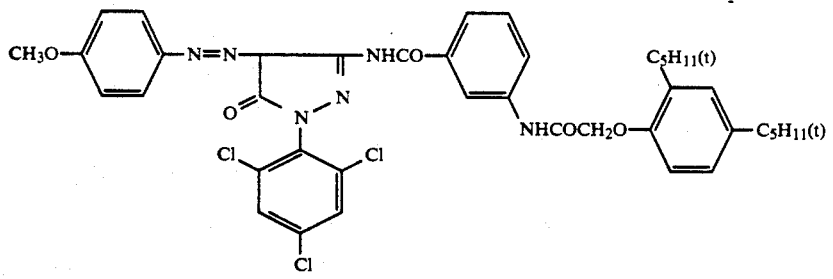
DD-1
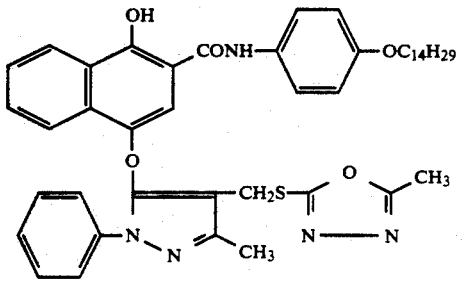
DD-2

-continued
Sample No. 101
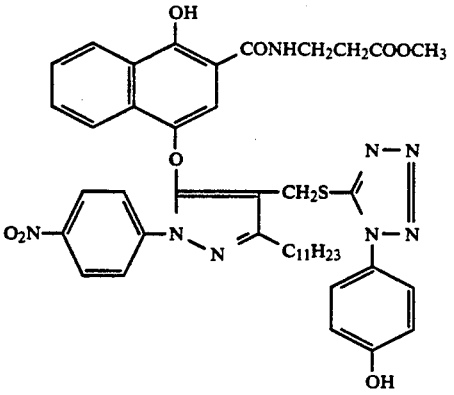
DD-3
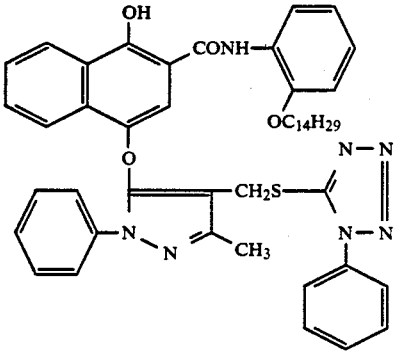
DD-4
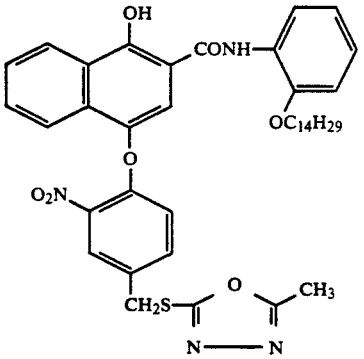
Oil-1
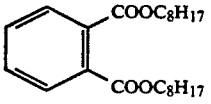
Oil-2
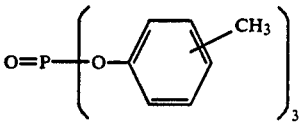
Oil-3

-continued
Sample No. 101
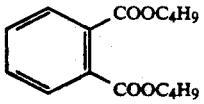
SC-1
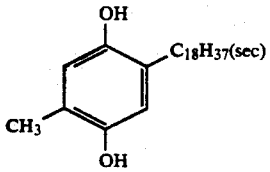
UV-1
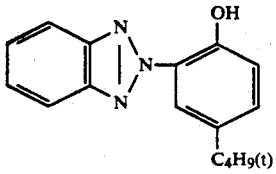
UV-2
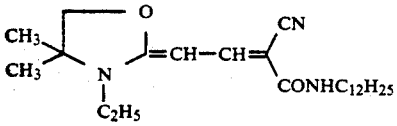
WAX-1
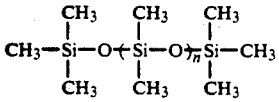
Weight average molecular weight Mw = 3,000
SD-1
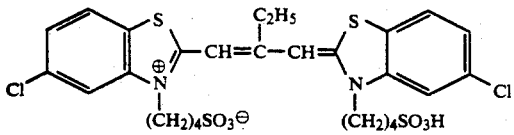
SD-2
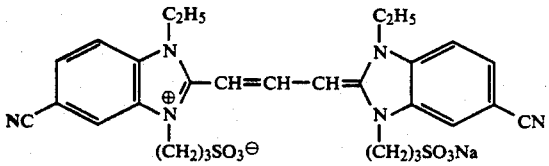
SD-3
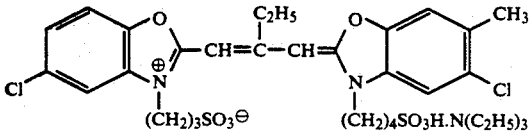
SD-4

-continued

Sample No. 101

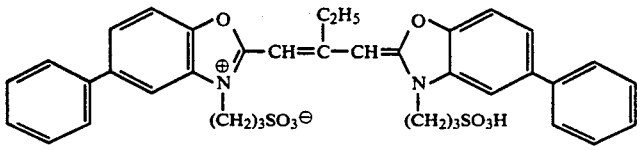

SD-5

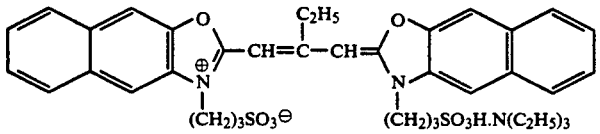

SD-6

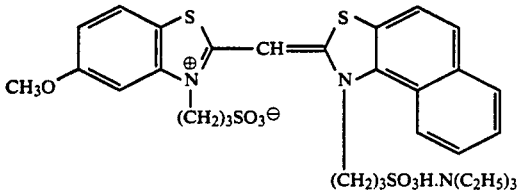

In addition to these compositions, a coating aid Su-1, a dispersing agent Su-2, a viscosity regulator, hardeners H-1 and H-2, a stabilizer ST-1, an antifogging agent AF-1 and two kinds of AF-2 having a weight average molecular weight of 100,000 or 1,100,000, respectively, were added.

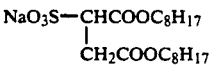

Su-1

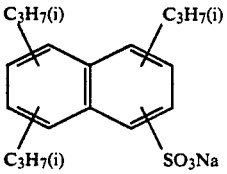

Su-2

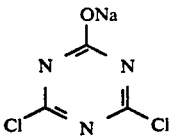

H-1

$(CH_2{=}CHSO_2CH_2)_2O$

H-2

-continued

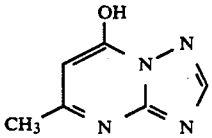

ST-1

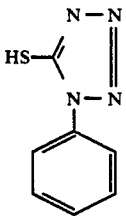

AF-1

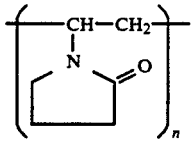

AF-2 n: Degree of polymerization

Sample Nos. 102 through 107 were prepared in the same manner as with Sample No. 101 except that the emulsions and sensitizing dyes in the blue-sensitive layers (Layers 9 and 10) and the DIR compounds in the green-sensitive layers (Layers 6 and 7) were changed as shown in Table 1.

TABLE 1

| Sample No. | | | 101 | 102 | 103 | 104 | 105 | 106 | 107 |
|---|---|---|---|---|---|---|---|---|---|
| Blue-sensitive layer | Layer 10 | Emulsion | B1 | B2 | B1 | B2 | B3 | B3 | B3 |
| | | Sensitizing dye | SD-6 | SD-6 | SS-13 | SS-13 | SS-13* | SS-13* | SS-13* |
| | Layer 9 | Emulsion | A1 | A2 | A1 | A2 | A3 | A3 | A3 |
| | | Sensitizing dye | SD-6 | SD-6 | SS-13 | SS-13 | SS-13* | SS-13* | SS-13* |
| Green-sensitive layer | Layer 7 | DIR compound | — | DD-2 | | DD-2 | DD-2 | DD-2 | DD-4 |
| | | (amount of addition) | | 0.02 | | 0.02 | 0.02 | 0.04 | 0.04 |
| | Layer 6 | DIR compund | — | DD-2 | | DD-2 | DD-2 | DD-2 | DD-4 |

TABLE 1-continued

| Sample No. | 101 | 102 | 103 | 104 | 105 | 106 | 107 |
|---|---|---|---|---|---|---|---|
| (amount of addition) | | 0.005 | | 0.005 | 0.005 | 0.005 | 0.005 |

Emulsion A2: A monodispersed silver iodobromide emulsion (average grain size 0.27 μm, average silver iodide content 3.5 mol %, distribution width 12%).

Emulsion A3: A tabular silver iodobromide emulsion (average grain size 0.52 μm, aspect ratio 6.6, average silver iodide content 2.0 mol %).

Emulsion B2: A monodispersed silver iodobromide emulsion (average grain size 0.38 μm, average silver iodide content 3.5 mol %, distribution width 15%).

Emulsion B3: A tabular silver iodobromide emulsion (average grain size 0.88 μm, aspect ratio 5.5, average silver iodide content 2.0 mol %).

*When Tabular Emulsions A3 or B3 was used, the amount of sensitizing dye used was 1.3 times that with Monodispersed Emulsions A2 or B2.

Using these sample Nos. 101 through 107, a JIS standard color slip (glossy type) produced by Nippon Kitei Kyokai and a cloth chart including five kinds of red cloth ranging from red to purple as determined on the hue ring were photographed, followed by the following color developing process.

After single color exposure through a 380–700 nm interference filter, each sample was developed and spectral sensitivity distribution was determined.

B, G and R separation exposure was conducted using a Wratten filter and the value for $\gamma_{SB}/\gamma_{SW}$ was calculated from $D_{min}+0.1$ in the exposure range of $\Delta \log E=1.0$.

| Processing procedures (38° C.) | |
|---|---|
| Color development | 3 minutes 10 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |
| Drying | |

The processing solutions used in the respective processing procedures had the following compositions:

| Color developer | |
|---|---|
| 4-amino-3-methyl-N-ethyl-N-(β-hydroxyethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |

Water was added to make a total quantity of 1 l (pH=10.0).

| Bleacher | |
|---|---|
| Iron (III) ammonium ethylenediaminetetraacetate | 100 g |
| Diammonium ethylenediaminetetraacetate | 10.0 g |
| Ammonium bromide | 150.0 g |

-continued

| Bleacher | |
|---|---|
| Glacial acetic acid | 10 ml |

Water was added to make a total quantity of 1 l, and aqueous ammonia was added to obtain a pH of 6.0.

| Fixer | |
|---|---|
| Ammonium thiosulfate | 175.0 g |
| Anhydrous sodium sulfite | 8.5 g |
| Sodium metasulfite | 2.3 g |

Water was added to make a total quantity of 1 l, and acetic acid was added to obtain a pH of 6.0.

| Stabilizer | |
|---|---|
| Formalin (37% aqueous solution) | 1.5 ml |
| Konidax (produced by Konica Corporation) | 7.5 ml |

Water was added to make a total quantity of 1 l.

From the developed films thus obtained, images were printed on color paper (Konica Color PC Paper type SR) so that gray of an optical density of 0.7 was reproduced into the same density.

The reproduced colors and original colors were each subjected to colorimetry using a color analyzer (CMS-1200, produced by Murakami Shikisai Sha) on the basis of the $L^*a^*b^*$ color system, and the chromaticity difference at maximum chromaticity and the average hue difference on the cloth chart were calculated for 5PB, 5G and 5R on the JIS standard color slip.

Chromaticity difference was determined by measuring (the distance from the crossing point to the original chromaticity point, in the length between the zeropoint) and the original chromaticity point when a line is drawn to pass the reproduced color points at an right angle with respect to the line passing on the zero point and the original chromaticity point on the $a^*b^*$ plain. As the value decreases, the brilliancy of the color reproduced increases.

Average hue difference on the cloth chart was calculated by plotting the original color and reproduced color on the $a^*b^*$ plain and averaging the absolute values ($\Delta\theta$) of the difference in the gradient $\theta$ of the line passing the zero point ($\Delta\theta m$). As the value for $\Delta\theta m$ decreases, the hue difference decreases.

From the spectral sensitivity distribution was determined the relative sensitivity at the peak wavelength on the spectral sensitivity distribution curve for $D_{min}+1.0$ in blue light colorimetry, relative to the sensitivity at 480 nm. For sensitivity comparison, the following equation was used.

$$\text{(Sensitivity at 480 nm/maximum sensitivity)} \times 100 \ (\%)$$

The results are summarized in Table 2.

TABLE 2

| Sample No. | | 101 Comparative | 102 Comparative | 103 Comparative | 104 Inventive | 105 Inventive | 106 Inventive | 107 Inventive |
|---|---|---|---|---|---|---|---|---|
| Blue-sensitive layer | λmax (nm) | 475 | 470 | 465 | 455 | 450 | 450 | 450 |
| | Relative sensitivity (%) at 480 nm | 80 | 55 | 35 | 20 | 7 | 6 | 6 |
| | $\gamma_{SB}/\gamma_{WB}$ | 1.15 | 1.30 | 1.18 | 1.43 | 1.58 | 1.70 | 1.68 |
| Chromaticity difference | | 10.1 | 9.2 | 11.3 | 9.0 | 9.3 | 8.5 | 8.5 |
| Hue difference Δθm | | 13.8 | 10.9 | 12.1 | 7.3 | 6.9 | 5.8 | 5.2 |

As seen from Table 2, when blue separation $\gamma$ alone was increased or the relative sensitivity at 480 nm of the blue-sensitive layer alone was decreased in Comparative Sample No. 101, it was difficult to reproduce brilliant chromaticity and exactly reproduce the original hue as in Sample Nos. 102 and 103, even when the other requirements were met.

On the other hand, Sample No. 104, which meets the above-mentioned requirements, and Sample Nos. 105 through 107, both of which use a tabular emulsion according to the present invention, are capable of exactly reproduce the original hue with no influence on the brilliancy of the primary colors.

What is claimed is:

1. A silver halide color photographic light-sensitive material comprising at least one blue-sensitive silver halide emulsion layer, at least one green-sensitive silver halide emulsion layer and at least one red-sensitive silver halide emulsion layer on a support, wherein the maximum sensitivity wavelength, $\lambda_B$, of the spectral sensitivity distribution in said blue-sensitive silver halide emulsion layer is in the range of 400 nm$\leqq\lambda_B\leqq$470 nm, the sensitivity of said blue-sensitive silver halide emulsion layer at 480 nm does not exceed 20% of the sensitivity at the maximum sensitivity wavelength, $\lambda_B$, and the relationship of the gradient of said blue-sensitive silver halide emulsion layer after blue light separation exposure, $\gamma_{SB}$, and of the gradient of said blue-sensitive silver halide emulsion layer after white light exposure, $\gamma_{WB}$, defined by the ratio of $\gamma_{SB}/\gamma_{WB}$ is $\leqq$1.25.

2. The material of claim 1, wherein the spectral sensitivity of the green-sensitivity layer has a maximum sensitivity wavelength between 520 nm$\leqq\lambda_G\leqq$570 nm.

3. The material of claim 1, wherein the spectral sensitivity of the red-sensitive layer has a maximum sensitivity wavelength between 590 nm$\leqq\lambda_R\leqq$640 nm.

4. The material of claim 1, wherein at least one the silver halide in the blue-sensitive layer, the green-sensitive layer or the red-sensitive layer, contains tabular silver halide grains, the aspect ratio of said tabular silver halide grains are not less than 3.0.

5. The material of claim 1, wherein $\gamma_{SG}/\gamma_{WG}\leqq$1.15 and $\gamma_{SR}/\gamma_{WR}\leqq$1.30.

6. The material of claim 1, wherein the ratio of the relationship $\gamma_{SB}\gamma_{WB}$ is $1.35\leqq\gamma_{SB}/\gamma_{WB}\leqq2.10$.

7. A silver halide color photographic light-sensitive material having at least one blue-sensitive silver halide emulsion layer, at least one green-sensitive silver halide emulsion layer and at least one red-sensitive silver halide emulsion layer on the support, wherein the maximum sensitivity wavelength $\lambda_B$ of the spectral sensitivity distribution in said blue-sensitive silver halide emulsion layer is in the range of 400 nm$\leqq\lambda_B\leqq$470 nm, the sensitivity of said blue-sensitive silver halide emulsion layer at 480 nm does not exceed 20% of the sensitivity at the maximum sensitivity wavelength, $\lambda_B$, and the relationship of the gradient of said blue-sensitive silver halide emulsion layer after blue light separation exposure, $\gamma_{SB}$, and of the gradient of said blue-sensitive silver halide emulsion layer after white light exposure, $\gamma_{WB}$, is between $1.45\leqq\gamma_{SB}/\gamma_{WB}\leqq2.00$, the spectral sensitivity of said green-sensitive layer has a maximum sensitivity wavelength being 530 nm$\leqq\lambda_G\leqq$555 nm, the spectral sensitivity of said red-sensitive layer has a maximum sensitivity wavelength being 600 nm$\leqq\lambda_B\leqq$630 nm.

8. The material of claim 7, wherein the maximum sensitivity wavelength, $\lambda_B$, of the spectral sensitivity distribution in said blue-sensitive silver halide emulsion layer is in the range of 410 nm$\leqq\lambda_B\leqq$460 nm.

* * * * *

UNITED STATES PATENT AND TRADEMARK OFFICE

CERTIFICATE OF CORRECTION

PATENT NO. :5,252,444

DATED :October 12, 1993

INVENTOR(S) :Yoshitaka Yamada, Hiroshi Shimazaki, and Satoru Shimba

It is certified that error appears in the above-indentified patent and that said Letters Patent is hereby corrected as shown below:

Claim 1, column 23, line 46, "≤" should read --≥--.

Claim 2, column 23, line 48, "green-sensitivity" should read --green-sensitive--.

Claim 4, column 24, lines 15-16, "at least one the silver halide" should read --the at least one silver halide layer--.

Claim 5, column 24, lines 20 and 21, "≤" should read --≥--.

Claim 6, column 24, line 23, "$\gamma_{SB}\gamma_{WB}$" should read --$\gamma_{SB}/\gamma_{WB}$--.

Abstract, line 16, "≤" should read --≥--.

Signed and Sealed this

Ninth Day of May, 1995

Bruce Lehman

*Attest:*

BRUCE LEHMAN

*Attesting Officer*

*Commissioner of Patents and Trademarks*